US005117089A

United States Patent [19]

Honkomp et al.

[11] Patent Number: 5,117,089

[45] Date of Patent: May 26, 1992

[54] STRUCTURAL SUPPORT FOR HERMETIC TERMINAL ASSEMBLY HEATER APPARATUS

[75] Inventors: Glenn A. Honkomp, Warren County; Thomas O. McNay, Clermont County; Larry G. Burrows, Hamilton County, all of Ohio

[73] Assignee: Emerson Electric Co., St. Louis, Mo.

[21] Appl. No.: 634,610

[22] Filed: Dec. 27, 1990

Related U.S. Application Data

[63] Continuation-in-part of Ser. No. 503,286, Apr. 2, 1990.

[51] Int. Cl.[5] ..... H05B 3/12; H01C 7/02

[52] U.S. Cl. ..... 219/201; 219/505; 392/455; 392/501; 392/502; 338/22 R; 338/318

[58] Field of Search ..... 219/201, 505; 338/22 R, 338/318; 392/501, 502, 455

[56] References Cited

U.S. PATENT DOCUMENTS

| | | | |
|---|---|---|---|
| 1,818,191 | 8/1931 | Boyer | 338/318 |
| 2,003,625 | 6/1935 | Boyer | 338/318 |
| 2,395,759 | 2/1946 | Priessman | 338/318 |
| 3,793,604 | 2/1974 | Duggan et al. | 338/22 R |
| 4,222,024 | 9/1980 | Ekowicki | 338/22 R |
| 4,685,025 | 8/1987 | Carlomango | 338/22 R |
| 4,786,762 | 11/1988 | Bowsky et al. | 174/152 GM |
| 4,797,534 | 1/1989 | Prager et al. | 338/22 R |

*Primary Examiner*—Bruce A. Reynolds
*Assistant Examiner*—John A. Jeffery
*Attorney, Agent, or Firm*—Polster, Polster and Lucchesi

[57] ABSTRACT

A heating apparatus for heating a fluid medium confined in a hermetically sealed housing chamber including a terminal assembly having a body member sealed in the housing chamber wall with pins extending in sealed relation therethrough to provide electrically conductive inner and outer pin segments respectively connected to heat transfer members and an electric power source, the heat transfer members including a heating element and a support for the heating element which is independent of a novel electrical connection between the inner pin segment and heating element to insure stable electrical connection and a minimum of vibration.

16 Claims, 2 Drawing Sheets

39
39
38
46
46
42
48
42

39
39
38
43
46
44
47
41
46
48
42
47
43
42
32
32
31
30
31
25
28
27
29
33
26
34
29
34

39
39
32
32
31
30
26
27
28
33
34
34

STRUCTURAL SUPPORT FOR HERMETIC TERMINAL ASSEMBLY HEATER APPARATUS

This invention constitutes a continuation-in-part of parent U.S patent application Ser. No. 07/503,286, filed Apr. 02, 1990, and as such, even more particularly relates to an improved structure for supporting the heating apparatus which is disclosed in the parent application.

BACKGROUND OF THE INVENTION

The present invention relates to a heater apparatus for heating fluid medium confined in a hermetically sealed chamber and more particularly to an apparatus which includes a heating element that extends directly into the sealed chamber.

In the refrigerant compressor art, it is generally known to heat the fluid medium confined in a crankcase of a refrigerant compressor by means of a PTC thermistor device confined in an insulating ceramic case such as disclosed in U.S. Pat. No. 4,236,065, issued to M.A. Yashin et al. on Nov. 25, 1980 and U.S. Pat. No. 4,544,316 issued to M. Takeuchi et al. on Feb. 17, 1987. An appropriately sized, heat conductive metallic sleeve member which is closed at one end and open at the other, has its opened end sealed to the wall of the crankcase with its closed end projecting into the crankcase chamber. A ceramic encased PTC heater is inserted into the sleeve opening and connected to an electrical source to heat fluid medium in the crankcase chamber through the surrounding heat conductive metallic sleeve member projecting into the crankcase.

The present invention recognizing that such past apparatus presents problems in heat loss through the insulating ceramic sleeve, the surrounding metallic sleeve and the housing to which it is attached and that the wattage required to apply the required heat is not directly responsive to the fluid medium confined by the crankcase housing and surrounding ambient conditions, provides a novel crankcase heater arrangement which avoids these past difficulties by eliminating the comparatively costly and difficult to manufacture and assemble heat conductive sleeve and by inserting a heating member electrically connected to a conventionally mounted terminal assembly to heat the fluid medium in a more direct manner without the aforedescribed concomitant heating losses through a heat dissipating sleeve and the crankcase housing to which it is mounted. Further, the crankcase heater arrangement of the present invention is more directly responsive to confined fluid medium and ambient temperature conditions so as to minimize wattage consumption and thus optimize overall heating efficiency.

Further the present invention of this continuation-in-part application includes a novel heater element electrical connection and support structure which is not only light in weight and economical to manufacture and assemble but which also provides stable electrical contact and insulation in those areas where such is required and which, at the same time, minimizes undesirable vibrational effects.

Various other features of the present invention will become obvious to one skilled in the art upon reading the disclosure set forth herein.

BRIEF SUMMARY OF THE INVENTION

More particularly, the present invention provides a novel heating apparatus to be mounted in a fluid medium containing chamber defined by a wall of a hermetically sealed housing comprising: a terminal assembly including a body member sealed to the housing wall, the body member having terminal pin means embedded in a seal extending between the terminal pin means and an aperture in the body member with an outer pin segment of the terminal pin means extending outwardly from the outer face of the wall to be electrically connected to an electric power source and an inner pin segment of the terminal pin means extending inwardly from the inner face of the wall into the fluid medium chamber; and, a heating element electrically connected to the inner pin segment of the terminal pin means to be disposed in the chamber to transmit heat to the fluid medium. In addition, the present invention provides a unique arrangement of combining and positioning a PTC thermistor disc with the terminal pins of a terminal assembly for heating a fluid medium in a more direct and efficient manner than heater elements of past arrangements. Further, the present invention provides for an insulating sleeve surrounding the inner pin segment extending into the fluid chamber with one end of the sleeve embedded in the seal between the pin and body member. Even further, the present invention of this continuation-in-part application provides for a support means for the heating element to firmly support such heating element independently of a unique partial loop arrangement of an electrically conductive wire assembly for the heating element to minimize vibration and to insure a stable electrical connection of the heating element to the inner pin segment.

It is to be understood that various changes can be made in one or more of the several parts of the apparatus disclosed herein without departing from the scope or spirit of the present invention. For example, other types and configurations of PTC thermistor heating units beside that disclosed can be utilized with the internal pin segments of the terminal assembly and the terminal assembly itself can be any one of a number of terminal assemblies known in the art, including those known to include a fuse-like area either on or adjacent to the terminal pin means.

BRIEF DESCRIPTION OF THE DRAWINGS

Referring to the drawing which discloses one advantageous embodiment of the present invention.

DETAILED DESCRIPTION OF THE DRAWING

Figure 1:
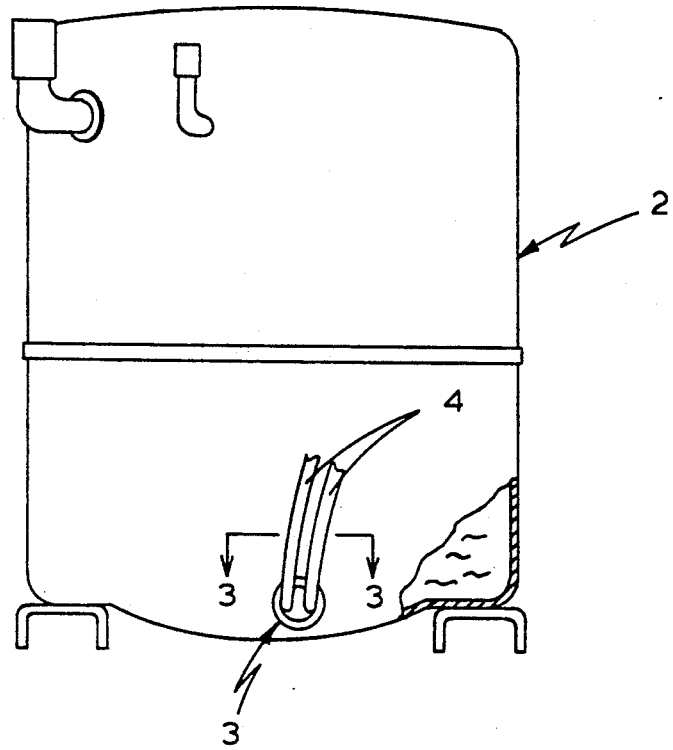
FIG. 1 is a side view of a hermetically sealed heater housing assembly in the general form of a refrigeration compressor crankcase heater which heater incorporates the novel terminal assembly heater of the present invention.

Referring to FIG. 1 of the drawing a hermetically sealed crankcase housing 2 of a configuration generally known in the refrigeration art is disclosed incorporating the novel heater apparatus 3 located directly within the hermetically sealed housing 2 and advantageously at the bottom of housing 2. Suitable electrical wires 4, leading from an electrical power source (not shown) are provided to connect to the outer pin segments of heater 3 disclosed in detail in FIG. 2 of the drawing.

Figure 2:
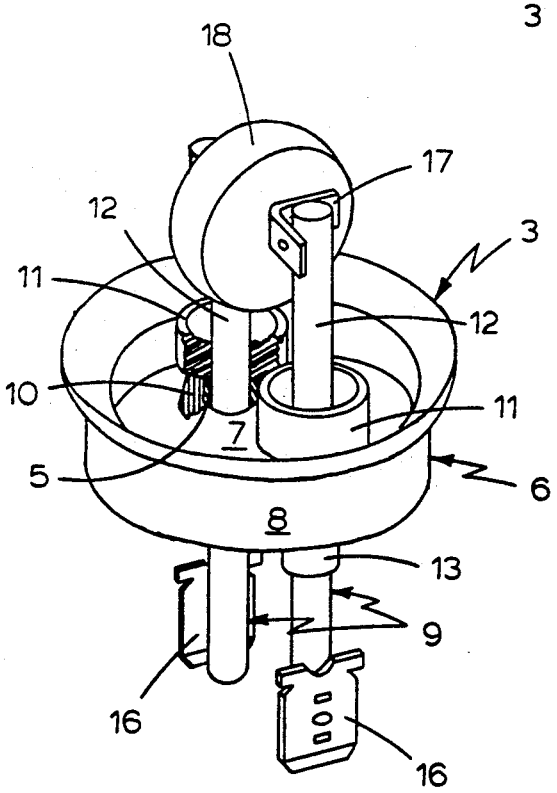
FIG. 2 is an enlarged, partially broken away isometric view of the novel terminal assembly heater arrangement incorporated in the heater housing of FIG. 1.
Figure 3:
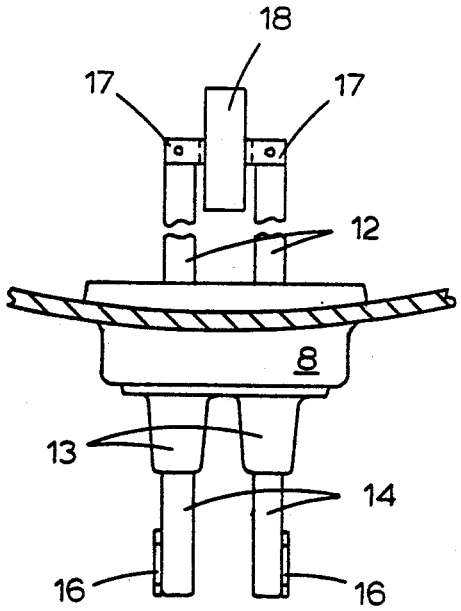
FIG. 3 is an enlarged, partially broken view of the terminal assembly heater and housing assembly taken in a plane through line 3—3 of FIG. 1.

As can be seen in FIG. 2, the heater apparatus 3 to be mounted in the wall confining electrically non-conductive refrigerating fluid medium in housing 2 is in the form of a terminal assembly including a cup-shaped body member 6 have a bottom or base 7 and a peripheral rim 8. The base 7, as is known in the art of terminal assemblies and therefore not shown in detail herein, is provided with a pair of spaced apertures therein through which a pair of spaced electrically conductive terminal pins 9 extend. As also is known in the art and shown at the broken away portion of FIG. 2, each of pins 9 is embedded in an appropriate seal 5 which is usually of glass and which extends between the outer periphery of the pin and a lip 10 integral with the aperture periphery so that pin 9 is in sealed relation with base or bottom 7. A suitable arc preventing insulating sleeve 11 of ceramic, glass or a composition of both surrounds each inner pin segment 12 with one end of the insulating sleeve 11 being embedded in the seal 5 and the other end of the sleeve being appropriately recessed to minimize the possibilities of arcing between inner pin segment 12 and cup-shaped body member 6. In this regard, an appropriate insulating silicone rubber coating 13 can be provided at the base of each outer pin segment 14 with the extremities of each outer pin segment having an electrical connector 16 fastened thereto to receive one of the lead wire ends of wires 4 (FIG. 1).

Electrically fastened to each extremity of each inner pin segment 12 of terminal pin 9 by some suitable means such as spot welding is one leg of a pair of mirror-image right angle support members 17 (only one of which can be seen in the drawing) the other leg of these support members is so arranged that these opposed legs face each other in spaced relation and serve to receive and conductively support therebetween by some suitable means such as spot welding, the opposite faces of an appropriate PTC thermistor disc 18 with the wider opposed face portions of such heater disc 18 extending in a longitudinal fashion proximate the longitudinally extending center line of the fluid chamber to enhance fluid medium heating capabilities of the heater. The thermistor disc 18 can be formed from any ore of a number known PTC thermistor discs which are formed from elements similar to those described in the aforementioned U.S Pat. Nos. 4,236,065 and 4,644,316.

Although, in accordance with the present invention, it is possible to locate the heating element at any one of a number of suitable location within hermetically sealed housing 2, it has been recognized to be advantageous that the heating element, in the form of the PTC thermistor disc 18, which can be covered with a suitable insulating material, such as epoxy coating, be located as shown in the lower portion of housing 2 to be more responsive to the electrically non-conductive fluid medium temperature and the surrounding ambient conditions, to optimize the power requirements as existing occasions require.

Figures 4, 5, 6:
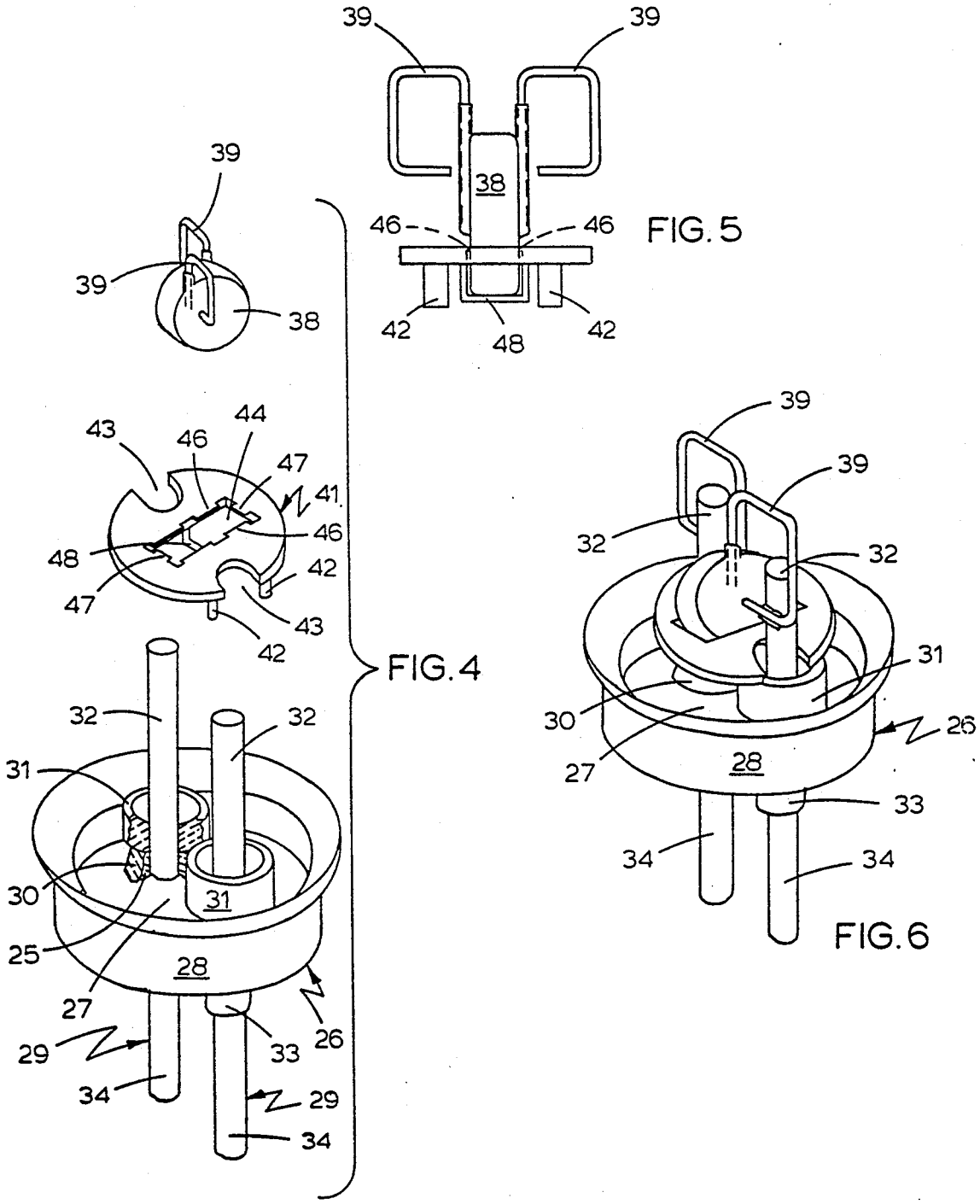
FIG. 4 is an exploded isometric view of a still further novel terminal assembly heater arrangement incorporating a novel modified electrical connection between the heater element and pin segments and a novel support for the heater element.
FIG. 5 is a side view of the heater element and support in assembled relation.
FIG. 6 is an isometric view of the assembled parts of FIGS. 4 and 5.

Referring to FIGS. 4–6 of the drawings, a still further novel terminal assembly heater arrangement is disclosed in the form of a terminal assembly including a cup-shaped body member 26 having a bottom or base 27 and a peripheral rim 28. Cup-shaped body member 26 is in many respects similar to that described in FIG. 2 of the drawings with base 27 being provided with a pair of spaced electrically conductive terminal pins 29 extending therethrough, as known in the art. As also is known in the art, each pin 29 is embedded in an appropriate seal 25, which is usually of glass and which extends between the outer periphery of the pin and a lip 30 integral with the aperture periphery so that pin 29 is in sealed relation with the base or bottom 27. A suitable arc preventing insulating sleeve 31, like insulating sleeve 11 of FIG. 2, also of ceramic, glass are composition of both surrounds each inner pin segment 32 of pin 29 with one end of insulating sleeve 31 being embedded in seal 25 and the other end of sleeve 31 being appropriately recessed to minimize the possibilities of arcing between inner pin segment 32 of pin 29 and cup-shaped body member 26. Here too, an appropriate insulating silicone rubber coating 33 can be provided at the base of each outer pin segment 34 and, if the occasion warrants, the extremities of each outer pin segment can be provided with an electrical connector (not shown) such as connector 16 of FIG. 2 or can be bare to nestingly engage with the female portion of some other suitable type of electrical connector having lead wires appropriately connected to an electrical power source.

In accordance with the modified embodiment of the invention as disclosed in FIG. 4 of the drawings, an electrically insulated PTC thermistor heater disc 38 is provided which can be of a disc shape similar to the thermistor heater disc 18 of FIG. 2 with the wider, opposed face portions of such heater disc 38 extending in a longitudinal fashion proximate the longitudinally extending center line of a fluid chamber to be heated to enhance fluid medium heating capabilities of the heater. A commercially available thermistor disc such as a Model ECB-1363A sold by Thermo Disc Company can be employed, such disc having a break point of 105°±5° C. with a resistance in a range of 500–3000 ohms at 25° C., a diameter of 0.575±0.025 inches and a thickness of 0.160±.010 inches before coating. The disc is rated at approximately twenty-two (22) watts at 0° C. The opposed faces of the disc, which are of different polarity, can be treated with a suitable coating of at least 0.007 inches thickness to meet U.L. requirements of 0.005 inches. Any one of a number of suitable epoxy resin insulator coatings can be employed, as can a suitable polymer insulator coating such as Teflon TM. Before a coating is applied to the thermistor disc 38 a pair of suitable electrically conductive lead wires 39 which can be of flexible nickel clad or copper alloy wire material of 0.040 inch thickness are soft soldered at corresponding extremities thereof to opposite polar faces of the thermistor disc 38 in offset relation to engage on opposed sides of the pair of inner pin segments 32 to which the other corresponding extremities of the lead wires 39 are eventually fused or welded. Advantageously, the major cantilevered portion of each of the lead wires 39 is in the form of a rounded loop for strain relief and, as shown in FIGS. 4 to 6 of the drawings, lead wire 39 extend substantially at opposed right angles in offset mirror-image, "Mickey-Mouse" ear-like fashion from the PTC thermistor heater disc 38 as offset, opposite partial loops of rectangular-like shape, each including three softly curved corners so that the opposite extremities can be fused to opposed sides of inner pin segments 32. It is to be noted that the ends of the extremities to be fused to inner pin segments 32 are each spaced from an adjacent polar face of PTC heater disc 38 a distance less than the cross-sectional distance or thickness of a conductive wire 39 so as to minimize possible wire interlocking of several heater assemblies during storage and shipment of such assemblies.

As can be seen in FIG. 4–6 of the drawings, a substantially flat, electrically non-conductive platform disc 41 is provided to firmly and stably support PTC thermistor heater disc 38 in position with offset ears formed by wires 39 appropriately fused or welded in electrically conductive position against inner pin segments 32. Platform heater disc 41 can be made from any one of a number of suitable insulative materials and advantageously can be formed from a suitable plastic insulative material such as "Valox" TM 310 sold by the General Electric Company. This material is suitable for use in hermetic compressor environments and meets U.L. minimum temperature requirements of 105° C. Platform disc 41 is provided with four (4) integral, spaced support feet 42 extending from the lower face thereof as shown in the drawings. These feet 42, which can vary in number and contour, are preselectively positioned and sized to engage against the upper surface of insulating sleeves 31, which surround inner pin segments 32, so as to hold and support the flat disc surface of platform disc 41 in spaced relation from the insulating sleeves 31—thus insuring that coated PTC thermistor heater disc 38 avoids undesirable abrasive, coating damaging contact therewith. Platform disc 41 is slotted along the periphery thereof with spaced, opposed, mirror-image peripheral slots 43 sized to snugly engage with spaced inner pin segments 32 to be in nesting and aligned, supportive engagement therewith. A longitudinally ex&:ending through slot 44 is provided in disc 41 with its longitudinal axis advantageously extending substantially normal to the lonqitudinal axis of opposed peripheral slots 43 so that through slot 44 extends between spaced, opposed peripheral slots 43. Through slot 44 is preselectively sized in length and width to allow snug and limited passage therethrough of a preselected portion of PTC thermistor heater disc 38, the heater disc 38 thus being firmly supported by insulated platform disc 41. In this regard, it is to be noted that through slot 44 is provided with opposed pairs of integral, flexible feathered edges 46 and 47 along the peripheral walls of the slot 44 to snugly engage against opposed polar wall and side faces of that portion of PTC thermistor heater disc 38 extending therethrough. It further is to be noted that support disc 41 is provided with an integral stirrup 48 which extends from the lower face of disc 41 between spaced integral legs 42 and transverse the longitudinal axis of slot 44 to further restrict movement of that portion of PTC thermistor disc 38 which extends through slot 44 so as to be firmly supported by supporting platform disc 41 free of abrasive, coating damaging contact with the several parts of cup-shaped body member 26 and, at the same time, insuring first fused contact of PTC thermistor heater disc 38 through projecting offset mirror-image ears 39 with inner pin segments 32, minimizing the effects of any undesirable, solder damaging vibrations which might occur during operations.

The invention claimed is:

1. A heating apparatus for a confined chamber comprising: a fluid medium containing chamber defined by walls of a hermetically sealed housing, one of said walls having an aperture therein; and, a unitary heating assembly including a body member extending through and sealed to said aperture in said wall, said body member having terminal pin means embedded in a seal extending between said terminal pin means and an aperture in said body member with an outer pin segment of said terminal pin means extending outwardly from the outer face of said wall to be electrically connected to an electric power source and an inner pin segment thereof projecting inwardly from the inner face of said wall into direct contact with the fluid medium of said fluid medium chamber, said unitary assembly having a heating element having an electrical connection to said inner pin segment of said terminal pin means to be disposed in said chamber to directly transmit heat to said fluid medium, said electrical connection for said heating element including a flexible conductive wire in the form of a partial loop with one extremity of said loop being conductively fused to said heating element and an opposite extremity being fused to said pin segment, said opposite extremity fused to said pin segment having the end thereof spaced from said heating element a distance less than the cross-sectional thickness of said wire to minimize wire interlocking; and support means for said heating element cooperatively and freely mounted relative said body member and said heating element to nestingly receive and surround a portion of said heating element and being sized to support said heating element in freely resting position independently of said electrical connection of said inner pin segment to said heating element to minimize vibration and to insure stable electrical connection of said heating element to said inner pin segment.

2. The heating apparatus of claim 1, said support means for said heating element extending between a portion of said heating element and said body member.

3. The heating apparatus of claim 1, said body member of said terminal assembly including an insulating sleeve surrounding said inner pin segment extending into said fluid chamber with one end of said insulating sleeve embedded in said seal, said support means for said heating element extending between said portion of said heating element and said insulating sleeve.

4. The heating apparatus of claim 1, said support means for said heating element including a recess therein preselectively sized to nestingly receive in snug and freely supportive engagement therewith a lower portion of said heating element.

5. The heating apparatus of claim 1, said support means extending between a portion of said heating element and said body member, said support means having support feet extending therefrom to engage against said body member of said terminal assembly.

6. The heating apparatus of claim 1, said support means for said heating element being preselectively sized and recessed to engagingly nest with said inner pin segment at a location spaced from said electrical connection of said heating element to said inner pin segment.

7. The heating apparatus of claim 1, said support means for said heating element comprising a substantially flat electrically non-conductive platform having spaced support feet extending from one face thereof to engage against said body member of said terminal assembly.

8. The heating apparatus of claim 1, said terminal pin means including at least two spaced inner pin segments, each surrounded by an insulating sleeve embedded in a seal extending between said pin and an aperture in said body member of said terminal assembly and said support means for said heating element comprising a substantially flat electricaily non-conductive plastic platform disc, said platform disc having spaced support feet integral therewith to extend from one face thereof, said spaced feet being preselectively positioned to engage against said insulating sleeves for said inner pin segments, said platform disc being sized and slotted along the periphery thereof to snugly receive said spaced inner pins in nesting engagement therewith and having a heating element recess therein preselectively sized to nestingly receive in snug supporting engagement therewith a portion of said heating element.

9. The heating apparatus of claim 8, said heating element recess being in the form of a longitudinally extending slot having integral flexible feathered edges along the peripheral walls thereof to engage against the wall faces of a portion of said heating element in support relation therewith.

10. The heating apparatus of claim 9, said slot having an integral stirrup extending from one face thereof between said spaced feet to restrict movement of and further support said portion of said heating element nestingly engaged in said slot.

11. A heating apparatus to be mounted in a refrigerating fluid medium containing chamber defined by an outer wall of a hermetically sealed compressor housing comprising:

a terminal assembly including a cup-shaped body member having a base and a peripheral rim extending therefrom sealed to the lower portion of said outer wall of said compressor housing, said base of said cup-shaped body member having a pair of spaced apertures therein;

a part of spaced terminal pins each embedded in a seal extending between said terminal pin and one of said spaced apertures in said body member in sealed relation therewith to provide a pair of spaced inner pin segments to be connected to a heating element and a pair of spaced outer pin segments to be connected to an electrical power source;

each of said inner pin segments extending into said fluid chamber being surrounded by an insulating sleeve with one end of said sleeve embedded in one of said aperture seals;

a heating element comprising an electrically insulated PTC thermistor heater disc treated with an insulating material with the opposed disc faces being of different polarity and wider than the thickness of said disc with said wider faces extending longitudinally proximate the longitudinal center line of said fluid medium containing chamber;

a substantially flat electrically non-conductive plastic platform disc, said platform disc having spaced support feet integral therewith to extend from one face thereof, said support feet being preselectively positioned and sized to firmly engage against said insulating sleeves for said inner pin segments, said disc platform being sized and slotted along the periphery thereof to snugly receive said spaced inner pin segments in nesting engagement therewith, said platform disc having a longitudinally extending slot therein to nestingly receive a portion of said thermal disc therein, said slot having integral flexible feathered edges along the peripheral walls thereof to engage against the wall faces of a portion of said heating element and having an integral stirrup extending from one face of said disc platform between said spaced feet to restrict movement of said portion of said thermal disc engaged in said slot; and a pair of electrical connectors to connect said inner pin segments to said thermal disc including a pair of spaced electrically conductive flexible wires, electrically connected at corresponding extremities to opposed polar faces of said thermal disc to extend substantially at opposed right angles in mirror image therefrom as opposite partial loops of rectangular-like shape each including three softly curved corners with said opposite extremities being fused to said spaced inner pin segments with the ends thereof being spaced from an adjacent polar face a distance less than the cross-sectional distance of said wire to minimize possible wire interlocking.

12. In combination with a unitary heating element, a support structure for said heating element to be electrically connected to at least one conductive pin segment extending from a base member including a slotted support platform preselectively configured to have a longitudinally extending slotted recess therein sized to freely and nestingly receive and surround in supportive rotation only a portion of said heating element, said longitudinally extending slotted recess having integral thin flexible feathered edges along the peripheral walls thereof to freely and snugly engage against opposed faces of said portion of said heating element nesting in supporting relation therewith, said support platform having spaced feet extending therefrom sized to support said platform in freely resting position relative said base member.

13. The support structure for a heating element of claim 12, said support platform having a slot along the periphery thereof to nestingly engage said pin segment.

14. The support structure for a heating element of claim 12, said longitudinally extending slot having an integral stirrup extending from one face thereof between said spaced feet to restrict movement of and further support said portion of said heating element nestingly engaged therein.

15. In combination with a unitary heating element an electrical connection for connecting a heating element to at least one pin segment including a flexible, conductive wire in the form of at least a partially enclosed loop electrically connected at one extremity to said heating element to extend in ear-like loop fashion from a face of said heating element with said other extremity abutting said inner pin segment to be conductively fused thereto said other extremity having the end thereof spaced from said heating element a distance less than the cross-sectional distance of said wire to minimize possible wire interlocking.

16. In combination with a unitary heating element, an electrical connection for connecting a PTC thermistor heater disc having opposed faces of different polarity to spaced opposed electrically conductive pin segments comprising: a pair of spaced, electrically conductive flexible wires electrically fused at corresponding extremities to said opposed faces of different polarity of said disc to extend substantially at opposed right angles in offset relation therefrom in the form of mirror-image, offset partially enclosed loops of rectangular-like shape with each loop including three softly curved corners with opposite extremities of said loops being fused to said spaced inner pin segments on opposed outer faces thereof with the ends of the loops being spaced from an adjacent polar face a distance less than the cross-sectional distance of each of said wires to minimize possible wire interlocking.

* * * * *

UNITED STATES PATENT AND TRADEMARK OFFICE

CERTIFICATE OF CORRECTION

PATENT NO. : 5,117,089

DATED : May 26, 1992

INVENTOR(S) : Glenn A. Honkomp et al

It is certified that error appears in the above-identified patent and that said Letters Patent is hereby corrected as shown below:

Column 1, line 25, delete "4,544,316" and insert -- 4,644,316 --.

Column 3, line 55, delete "ore" and insert -- one --.

Column 5, line 39, delete "ex&:nding" and insert -- extending --.

Signed and Sealed this

Fourteenth Day of September, 1993

*Attest:*

*Attesting Officer*

BRUCE LEHMAN

*Commissioner of Patents and Trademarks*